US007052208B2

(12) United States Patent
Gardner

(10) Patent No.: US 7,052,208 B2
(45) Date of Patent: May 30, 2006

(54) DISCHARGE CONTROL SYSTEM FOR A RESERVOIR

(76) Inventor: Kenneth E. Gardner, 5566 South 200 West, Ogden, UT (US) 84405

( * ) Notice: Subject to any disclaimer, the term of this patent is extended or adjusted under 35 U.S.C. 154(b) by 0 days.

(21) Appl. No.: 10/855,084

(22) Filed: May 26, 2004

(65) Prior Publication Data

US 2005/0265787 A1 Dec. 1, 2005

(51) Int. Cl.
*E02B 13/00* (2006.01)

(52) U.S. Cl. ..... 405/52; 405/53; 405/80; 405/108; 137/407; 251/5

(58) Field of Classification Search ..... 405/52–55, 405/107, 108, 80; 137/407; 251/5
See application file for complete search history.

(56) References Cited

U.S. PATENT DOCUMENTS 3,805,817 A * 4/1974 Smith ..... 137/8
3,854,291 A * 12/1974 Perkins ..... 405/108
4,225,434 A * 9/1980 Ernst et al. ..... 405/96
4,645,377 A * 2/1987 Vesterby ..... 405/50
5,727,593 A * 3/1998 Duer ..... 137/846
5,769,125 A * 6/1998 Duer et al. ..... 137/844
6,575,425 B1 * 6/2003 Betz ..... 251/5

* cited by examiner

*Primary Examiner*—Frederick L. Lagman
(74) *Attorney, Agent, or Firm*—Fehr Law Firm; Thompson E. Fehr

(57) ABSTRACT

A discharge control system for a reservoir having a pressure-communicating valve in a valve chamber with the inlet of the pressure-communicating valve connected the reservoir outlet aperture and the outlet of the pressure-communicating valve connected to a discharge aperture in the containment structure for the valve chamber. An auxiliary reservoir outlet aperture enables water to flow from the reservoir into the valve chamber, submerging the pressure-communicating valve. Water flows from the valve chamber through a valve chamber outlet aperture that is substantially the same as the auxiliary reservoir outlet aperture and is located at substantially the same height as the center of the reservoir outlet aperture. One or more supplemental auxiliary reservoir outlet apertures are located at incrementally greater heights in the containment wall for said reservoir to assure that water will enter and leave the valve chamber at the same rate under all conditions.

19 Claims, 6 Drawing Sheets

DISCHARGE CONTROL SYSTEM FOR A RESERVOIR

BACKGROUND OF THE INVENTION

1. Field of the Invention

This invention relates to a system for controlling the flow of water from a basin for retaining water.

2. Description of the Related Art

When runoff of water has the potential for damaging property, grading of land from which the water runs is often done in order to direct the water into a reservoir for temporary storage.

Such reservoirs are called by various names. Some of these are debris basin, containment basin, detention basin, and retention pond.

The size of the reservoir is determined by several factors, such as expected precipitation, the total area upon which such precipitation may fall, the percentage of moisture which will be absorbed by the soil, and the rate at which water may be released from the reservoir.

Usually regulatory authorities establish a given volume of water per unit of time that may flow through the stream or channel which carries the water that leaves the reservoir. For convenience, such stream or channel will, for the purposes of this patent application, be termed the "outflow channel."

Traditionally these reservoirs use orifice-type outlet controls that discharge increased flows under increased water pressure (head). Basically, a reservoir outlet aperture exists in the containment wall of the reservoir, usually near the bottom of the reservoir, through which the discharged water can flow. The higher the level of the water in the reservoir, the greater will be the water pressure at the reservoir outlet aperture; and, consequently, the greater will be the volume of water per unit of time which flows through the aperture.

In order to assure that the maximum permissible volume of water per unit time flowing through the outflow channel is never exceeded, the size of the reservoir outlet aperture is selected so that only this volume of water will flow through the reservoir outlet aperture when the water in the reservoir is at its highest level.

This necessarily means that when the level of water in the reservoir is below its maximum level, the flow through the reservoir outlet aperture will be less than the regulatory authority permits. Indeed, the lower the level of water in the reservoir, the less will be the volume of water per unit of time that flows through the reservoir outlet aperture.

Because the maximum flow through the outflow channel will occur only for the time when the level of water in the reservoir is at its highest position, the volume of the reservoir must be greater than it would have to be if the maximum flow through the outflow channel could occur for a longer period of time.

Of course, a larger reservoir requires more land and costs more money to construct.

The Red Valve Company, Inc. of Carnegie, Pa., has manufactured and marketed a line of valves under the trademarked name TIDEFLEX, which valves allow water to flow from the valves only when the upstream pressure is greater than the downstream pressure. The valves have a duckbill shape that precludes water from flowing in a reverse direction, i.e., they constitute check valves for the water. Such valves are most often utilized where water under pressure is to be discharged into other water below the surface of such other water.

The Red Valve Company, Inc. owns U.S. Pat. No. 4,268,005 which covers a "pinch valve" that has a sleeve inside a conduit with valves to pump a fluid between the sleeve and that conduit in order to collapse the sleeve partially or completely and thereby restrict the flow of liquid through the sleeve. No use was, however, suggested for the sleeve other than its employment within the conduit; and, when collapsed, the pinch valve has three arms projecting from a central location, rather than a flat duckbill.

BRIEF SUMMARY OF THE INVENTION

The present inventor recognized that it is the differential pressure between the upstream side of the reservoir outlet aperture, which as noted above is located in the containment wall of the reservoir, and the downstream side of the reservoir outlet aperture that controls the volume of water which flows through the reservoir outlet aperture per unit of time, that the pressure on the downstream side of the reservoir outlet aperture could be increased by submerging on the downstream side of the reservoir outlet aperture a valve through which the pressure of the water used to submerge such valve would be transmitted to the water flowing through the reservoir outlet aperture, and that the TIDEFLEX valve could be modified for such use.

A containment structure holds the valve. The inlet of the valve is connected to the reservoir outlet aperture, and the outlet of the valve is connected to and communicates with a discharge orifice or aperture in a wall of the valve chamber.

Water is supplied to the valve chamber from the reservoir with an auxiliary reservoir outlet aperture. The present inventor further recognized that by having a valve chamber outlet aperture that is substantially the same as that of the auxiliary reservoir outlet aperture and by having the center of the valve chamber outlet aperture at the same height as the center of the reservoir outlet aperture, the pressure on the outside of the valve would remain constant no matter what the level in the reservoir is (as long as it is at least as high as the height of the auxiliary reservoir outlet aperture).

The size of the reservoir outlet aperture is, thus, selected such that at this constant pressure on the valve, the flow from the reservoir outlet aperture and through the valve will be the maximum permissible flow.

Initially, it would seem that pressure used against the flow of water from the reservoir outlet aperture would increase the time required to drain the reservoir; but the following discussion demonstrates that this is surprisingly not the case.

DETAILED DESCRIPTION OF THE INVENTION

Figure 1:
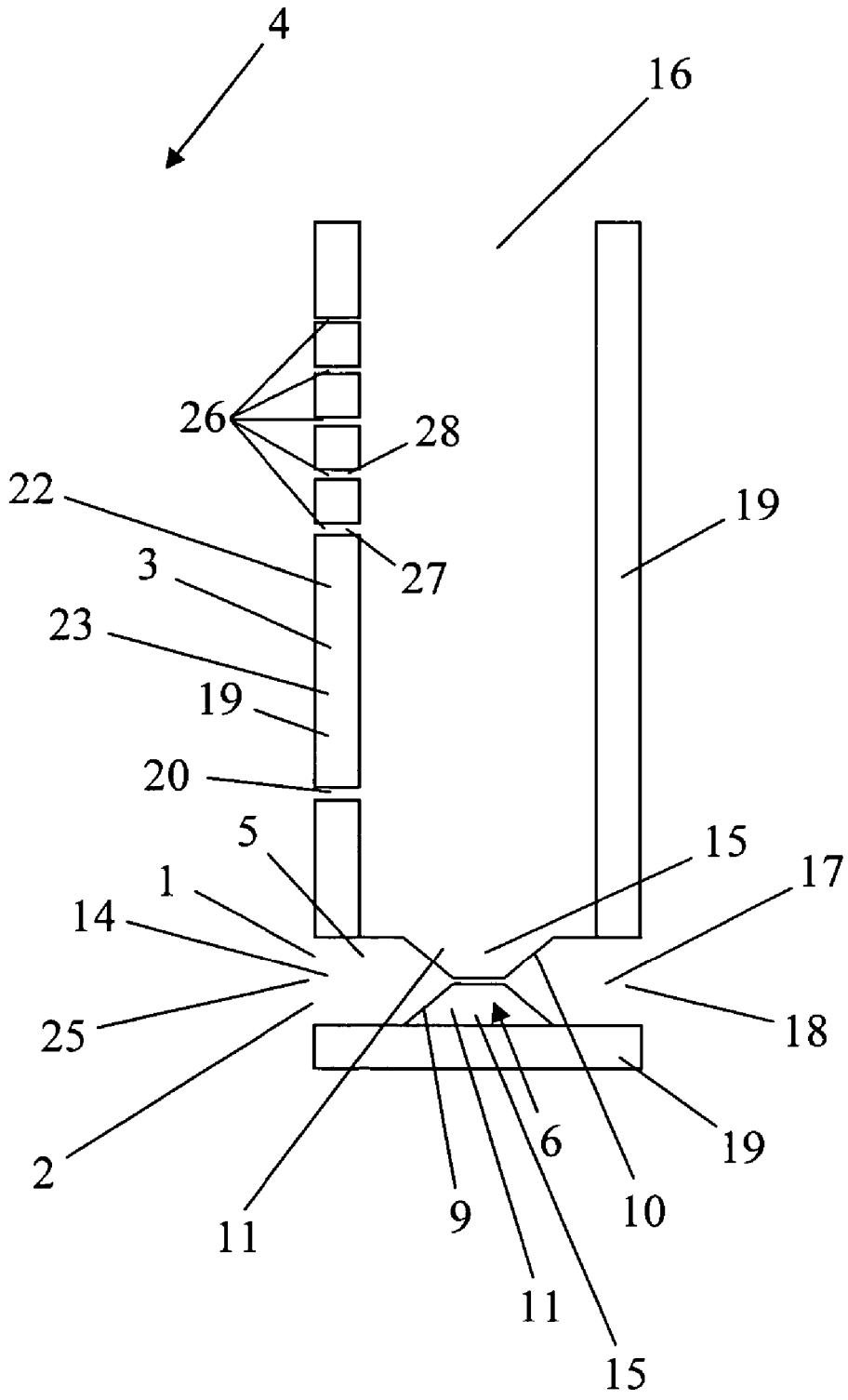
FIG. 1 provides a cutaway lateral view of the Discharge Control System for a Reservoir.
Figure 2:
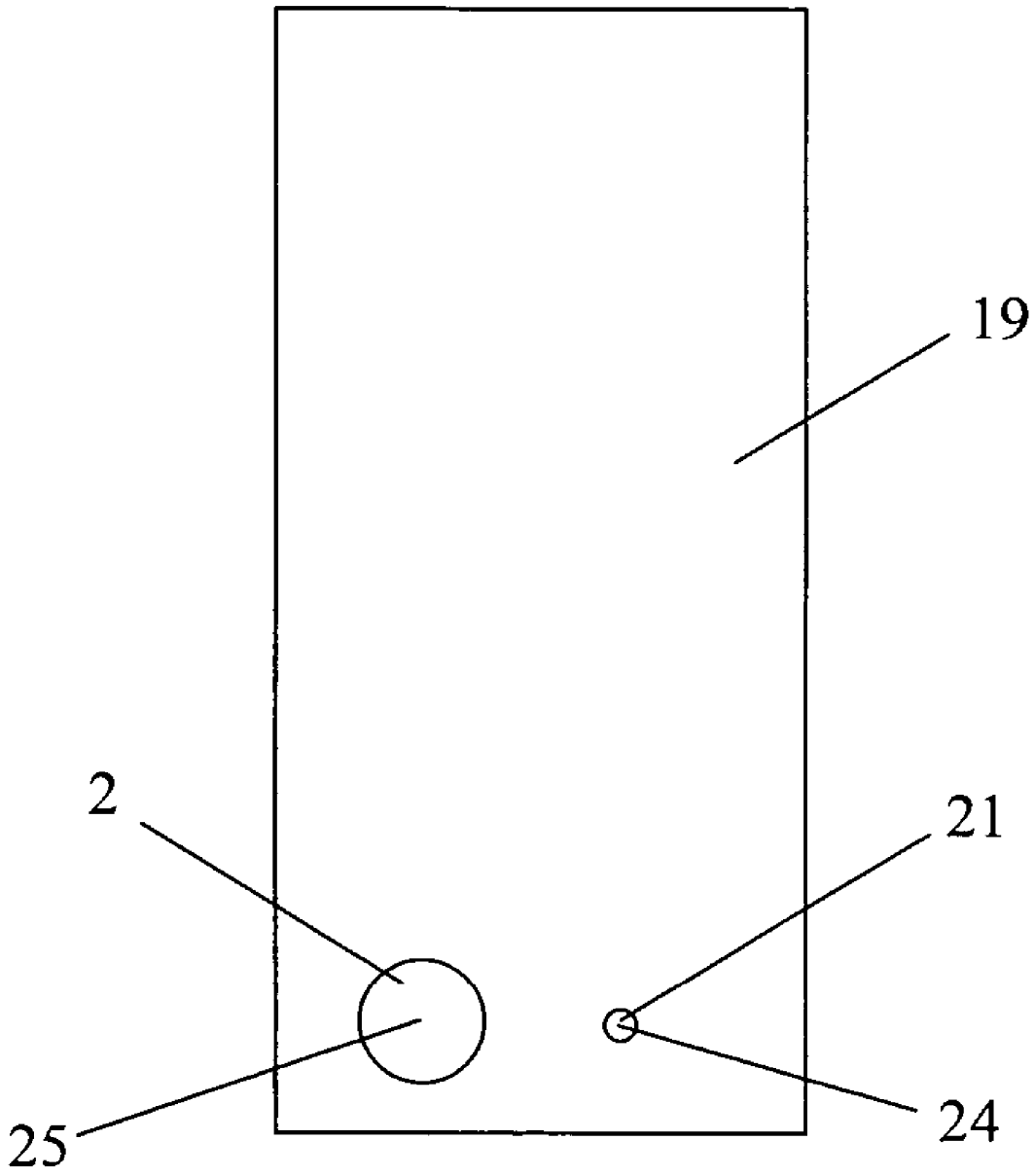
FIG. 2 shows the Discharge Control System from downstream.

The present inventor recognized that it is the differential pressure between the upstream side 1 of the reservoir outlet orifice or aperture 2, which as noted above and seen in FIG. 1 and FIG. 2, is located in the containment wall 3 of the reservoir 4, and the downstream side 5 of the reservoir outlet aperture 2 which controls the volume of water that flows through the reservoir outlet aperture 2 per unit of time, that the pressure on the downstream side 5 of the reservoir outlet aperture 2 could be increased by submerging on the downstream side 5 of the reservoir outlet aperture 2 a valve 6 through which the pressure of the water used to submerge such valve 6 would be transmitted to the water flowing through the reservoir outlet aperture 2, and that the TIDEFLEX valve could be modified for such use.

Figure 3:
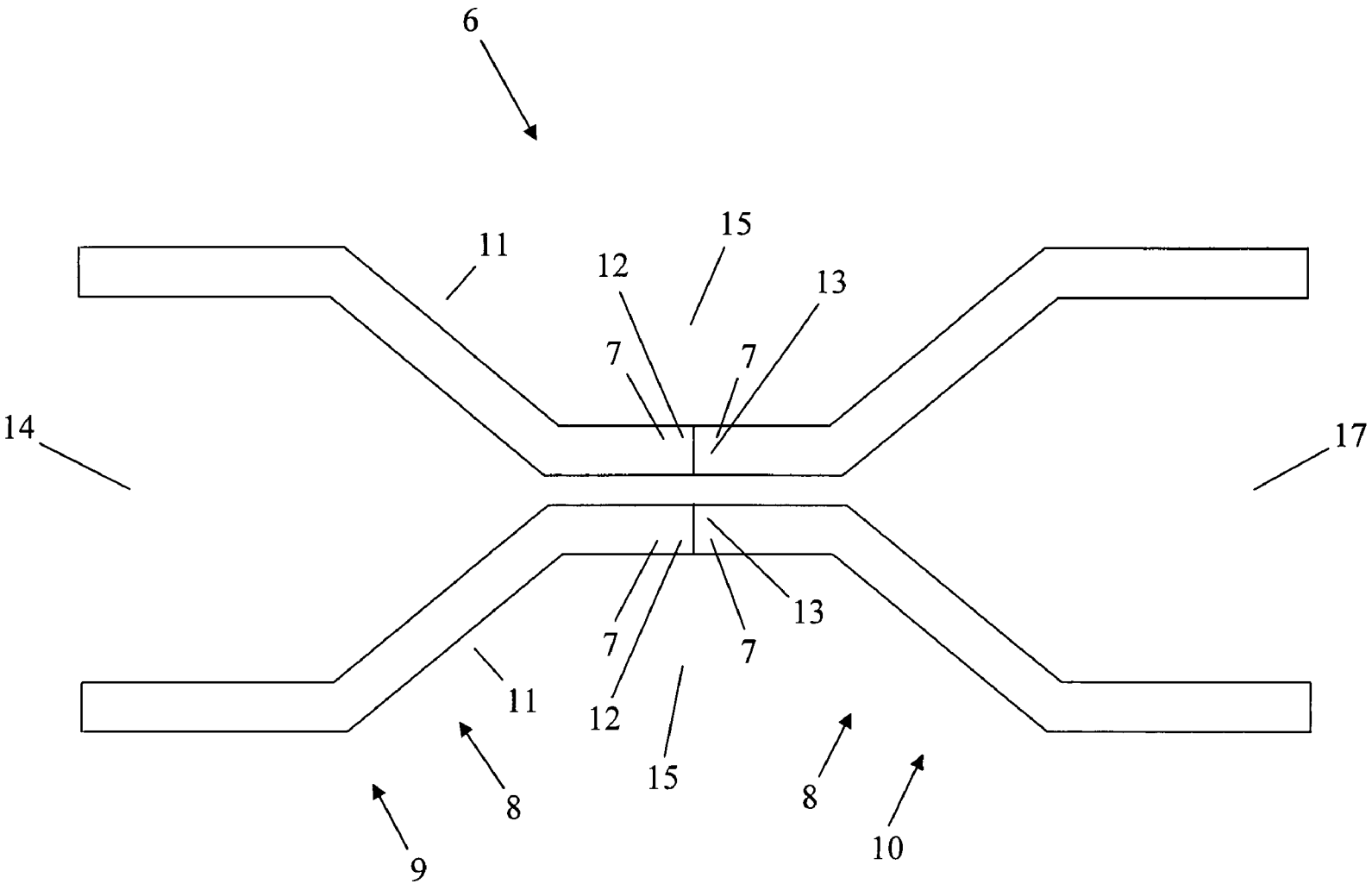
FIG. 3 is a cutaway lateral view of a dual-duckbill valve.

The modification of the TIDEFLEX valve comprises, as illustrated in FIG. 3, placing adjacent to one another and connecting together the traditional exit ends 7 of two such duckbill valves 8. This is contrary to the teaching in the art of such valves 8 because, although water flows through the valve 9 connected to the reservoir outlet aperture 2 in the normal direction, it must flow through the other valve 10 in the reverse direction—the very situation which the duckbill valve 8 is intended to preclude.

In the present invention, water entering the upstream duckbill valve 9 and having greater pressure that that of the water surrounding the outside 11 of the valve 9 will force the lips 12 of the upstream duckbill valve 9 apart. Since the lips 12 of the upstream duckbill valve 9 are connected to the lips 13 of the downstream duckbill valve 10, the movement of the lips 12 of the upstream duckbill valve 9 will pull open the lips 13 of the downstream duckbill valve 10.

This is much the same as the flow through the pinch valve of U.S. Pat. No. 4,268,005. However, because the conduit of that patent has been eliminated, the pressure of the water within which the dual-duckbill valve 6 has been submerged will be transmitted to the water flowing through the dual-duckbill valve 6 so that the flow through the dual-duckbill valve 6 will be proportional to the pressure differential between (a) the water in the reservoir 4 at the level of the inlet 14 to the dual-duckbill valve 6, the inlet 14 of which dual-duckbill 6 valve is connected to and communicates with the reservoir outlet aperture 2 and, thus, has (if maintained at the same elevation) the same pressure, and (b) the pressure of the water surrounding the outside 15 of the dual-duckbill valve 6.

Since, knowing the need to communicate the pressure of the water outside the valve 6 to the water inside the valve 6, one skilled in the art could conceive of other valves 6 that would accomplish this purpose, a valve 6 having this capability will be termed, for the purposes of this patent application, a "pressure-communicating" valve 6.

The pressure-communicating valve 6 is placed within a chamber 16 which is capable of holding water and which, for the purposes of this patent application, is termed the "valve chamber" 16. The outlet 17 of the pressure-communicating valve 6 is connected to and communicates with a discharge orifice or aperture 18 in the containment structure 19 of the valve chamber 16.

Placing an auxiliary reservoir outlet orifice or aperture 20, which communicates with the valve chamber 16, in the containment wall 3 for the reservoir 4 enables the valve chamber 16 to begin filling with water, as long as the level of water in the reservoir 4 is above the level of the auxiliary reservoir outlet aperture 20.

Also, an additional orifice or aperture, which, for the purposes of this patent application is designated the "valve chamber outlet aperture" 21 is placed in the containment structure 19 for the valve chamber 16.

And preferably a portion 22 of the containment structure 19 for the valve chamber 16 serves as a portion 23 of the containment wall 3 for the reservoir 4; and located in such portion 22 are the reservoir outlet aperture 2 and the auxiliary reservoir outlet aperture 20.

With the goal being to assure that the reservoir 4 always empties at the maximum permissible rate, it is desired to establish a constant pressure on the outside 15 of the pressure-communicating valve 6 and to determine the size of the reservoir outlet aperture 2 that will result in the maximum permissible rate of discharge from the reservoir 4 at this pressure.

Another important recognition by the present inventor was that if water entered and left the valve chamber 16 at the same rate, the level of water in the valve chamber 16 would remain constant and that this would be achievable if and only if the valve chamber outlet aperture 21 and the auxiliary reservoir outlet aperture 20 were substantially the same and the center 24 of the valve chamber outlet aperture 21 were at substantially the same height as the center 25 of the reservoir outlet aperture 2.

Thus, using ordinary engineering principles, the valve chamber outlet aperture 21 is designed to pass the same volume of water per unit time as does the auxiliary reservoir outlet aperture 20 when the pressure on the outside of the pressure-communicating valve 6 is the desired quantity lower than the pressure inside the pressure-communicating valve 6. Since, with the water flowing into and out of the valve chamber 16 at equal rates, the level of water in the valve chamber above the valve chamber outlet aperture 21 will, under equilibrium conditions, be the same as the level of water in the reservoir 4 above the auxiliary reservoir outlet aperture 20, the pressure on outside of the pressure-communicating valve 6 is that generated by a column of water equal to the height of water in the reservoir 4 above the auxiliary reservoir outlet aperture 20. And the pressure inside the pressure-communicating valve 6 is that generated by water in the reservoir 4 above the reservoir outlet aperture 20. Consequently, the pressure differential on the pressure-communicating valve 6 is (as long as the level of water in the reservoir 4 is above the auxiliary reservoir outlet aperture 20) consistently that created by the water in the reservoir between the auxiliary reservoir outlet aperture 20 and the reservoir outlet aperture 2. Thus, the desired pressure differential is attained by placing the auxiliary reservoir outlet aperture 20 an appropriate distance above the reservoir outlet aperture 2.

This is opposed to the situation where the reservoir simply drains through the reservoir outlet aperture 2 with no pressure (other than atmospheric pressure, which equally encourages the flow by pressing on the water in the reservoir 4, thereby creating a net neutral effect on flow) impeding the flow so that the pressure differential across the reservoir outlet aperture 2 decreases as the level of the reservoir 4 decreases.

Therefore, in the present invention, after having determined the desired pressure differential and the corresponding distance between the auxiliary reservoir outlet aperture 20 and the reservoir outlet aperture 2, the size of the reservoir outlet aperture 2 is selected so that the volume of water flowing through the reservoir outlet aperture 2 at the desired fixed pressure differential will be equal to the maximum permissible volume of water per unit time flowing through the outflow channel.

Consequently, rather than having the maximum flow only when the reservoir 4 is full, the maximum flow through the reservoir outlet aperture 2 will occur from the time the level of water in the reservoir 4 is full until the time the level of water in the reservoir 4 reaches the level of the auxiliary reservoir outlet aperture 2. As indicated above, this enables a smaller reservoir 4, which occupies a more limited geographical space, adequately to retain the same volume of water as would a larger reservoir 4 with only a reservoir outlet aperture 2.

Were the valve chamber outlet aperture 21 not at substantially the same level as the reservoir outlet aperture 20, the valve chamber outlet aperture 21 could, for a given level of water in the reservoir 4, be designed to have the same rate of flow as does the auxiliary reservoir outlet aperture 20. The rates for the flow through the valve chamber outlet aperture 21 and the auxiliary reservoir outlet aperture 20 would, however, be different from one another for any other level of water in the reservoir 4.

Even with the present invention, though, a refinement is necessary if the level of water in the valve chamber 16 becomes higher than the auxiliary reservoir outlet aperture.

This is the result of the fact that even though the height of the column of water in the valve chamber 16 above the valve chamber outlet aperture 21 will still be the same as the height of the column of water in the reservoir 4 above the auxiliary reservoir outlet aperture 20, the rate of flow through the auxiliary reservoir outlet aperture 20 will be determined by the pressure differential across the auxiliary reservoir outlet aperture 20.

When the level of water in the valve chamber 16 is below the auxiliary reservoir outlet aperture 20, this pressure differential is that generated by the column of water in the reservoir 4 above the auxiliary reservoir outlet aperture 20; but when the level of water in the valve chamber 16 is above the auxiliary reservoir outlet aperture 20, the critical pressure differential for determining the rate of flow through the auxiliary reservoir outlet aperture 20 is that created by the difference between the level of water in the reservoir 4 above the auxiliary reservoir outlet aperture 20 and the level of water in the valve chamber 16 above the auxiliary reservoir outlet aperture 20.

Therefore, when the level of water in the valve chamber 16 is above the auxiliary reservoir outlet aperture 20, the pressure differential across the valve chamber outlet aperture 21 is greater than the pressure differential across the auxiliary reservoir outlet aperture 20; so, water flows through the valve chamber outlet aperture 21 faster than it does through the auxiliary reservoir outlet aperture 20.

In order to correct this situation, the present inventor has devised an incremental solution.

One or more supplemental auxiliary reservoir outlet orifices or apertures 26, which communicate with the valve chamber 16, are preferably created at incrementally greater heights in the containment wall 3 for the reservoir 4 above a level in the containment wall 3 for the reservoir 4 at which a level of water in the reservoir 4 will cause the level of water in the valve chamber 16 to exceed the height of the auxiliary reservoir outlet aperture 20.

In order to do this, in accordance with ordinary engineering principles, one employs the formula $$Q=Ca(2gh)^{1/2}$$

where "Q" represents the flow of water in cubic feet per second through an orifice or aperture, "C" is a coefficient of 0.65, "a" is the area of the orifice or aperture in square feet, "g" is the gravitational constant of 32.2 feet per second squared, and "h" is the height in feet of a column of water that would generate the pressure differential that exists across the orifice or aperture.

Thus in a preferred method for determining the area of the first and lowest supplemental auxiliary reservoir outlet aperture 27, the rate of flow $Q_v$ is calculated for the flow through the valve chamber outlet aperture 21 when the level of water in the valve chamber 16 is at a desired height for the second supplemental auxiliary reservoir outlet aperture 28; and the rate of flow $Q_r$ is calculated for the flow through the auxiliary reservoir outlet aperture 20 for the same condition. Then one uses the difference $Q_v-Q_r$ in place of Q in the formula to determine the area of the lowest supplemental auxiliary reservoir outlet aperture 27.

Similarly, for the area of the $n^{th}$ supplemental auxiliary reservoir outlet aperture 26, one uses the formula to calculate the flow $Q_{vn}$ through the valve chamber outlet aperture 21 when the level of water in the valve chamber 16 is at a desired height for the $n+1^{st}$ supplemental auxiliary reservoir 26, the flow $Q_{rn}$ through the auxiliary reservoir outlet aperture 20 for this condition, the flow $Q_{s1}$ through the $1^{st}$ supplemental auxiliary reservoir outlet aperture 27 under this condition, and the flow through each supplemental auxiliary reservoir outlet aperture 26 up to and including the $n-1^{st}$ supplemental auxiliary reservoir outlet aperture 26 for this condition. The sum of the flows through the auxiliary reservoir outlet aperture 20 and each of the supplemental auxiliary reservoir outlet apertures 26 through the $n-1^{st}$ supplement auxiliary reservoir outlet aperture is subtracted from the flow $Q_{vn}$ through the valve chamber outlet aperture 21, and this resultant difference is then inserted into the formula to calculate the area of the $n^{th}$ supplemental auxiliary reservoir outlet aperture 26.

When a portion 22 of the containment structure 19 for the valve chamber 16 serves as a portion 23 of the containment wall 3 for the reservoir 4, the supplemental auxiliary reservoir outlet apertures 26 are preferably located in such portion 22 and are, of course, located above the auxiliary reservoir outlet aperture 20.

Figure 4:
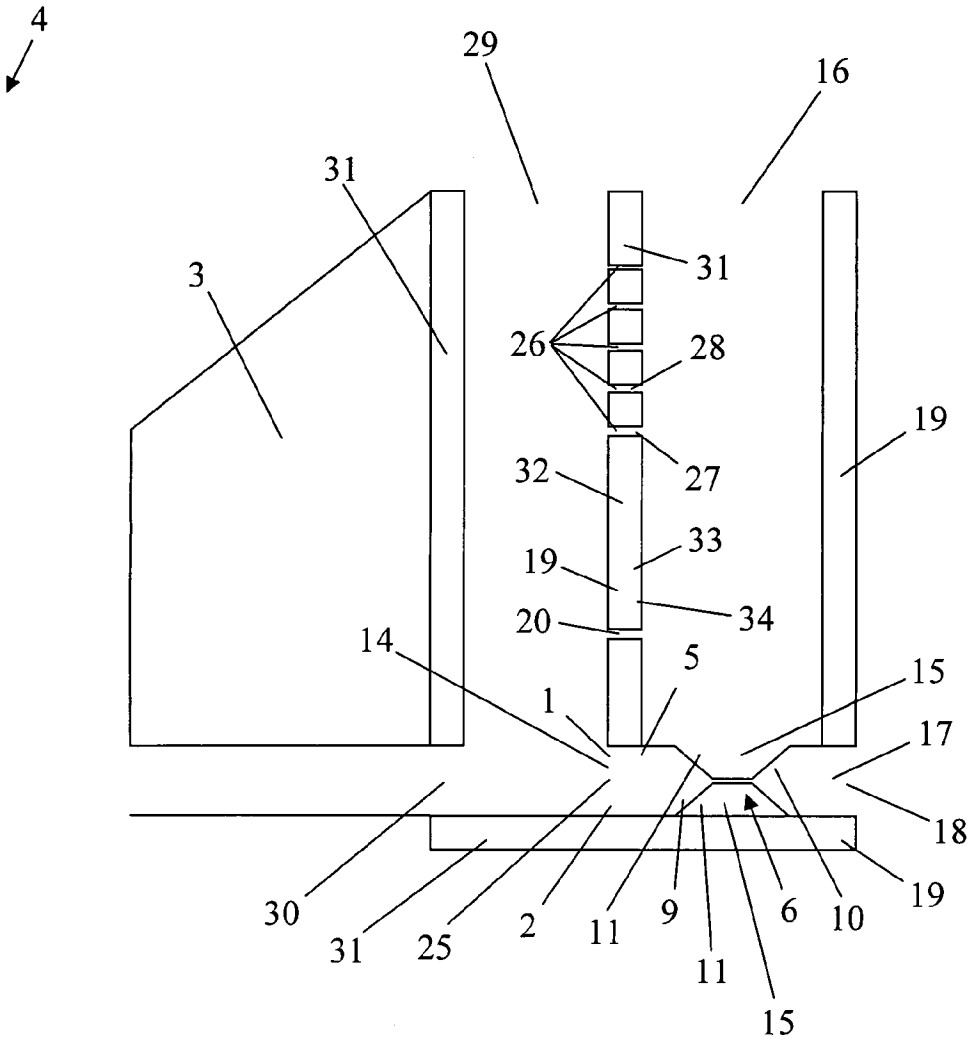
FIG. 4 illustrates, in a cutaway lateral view, an embodiment of the Discharge Control System that employs a collection box.
Figure 5:
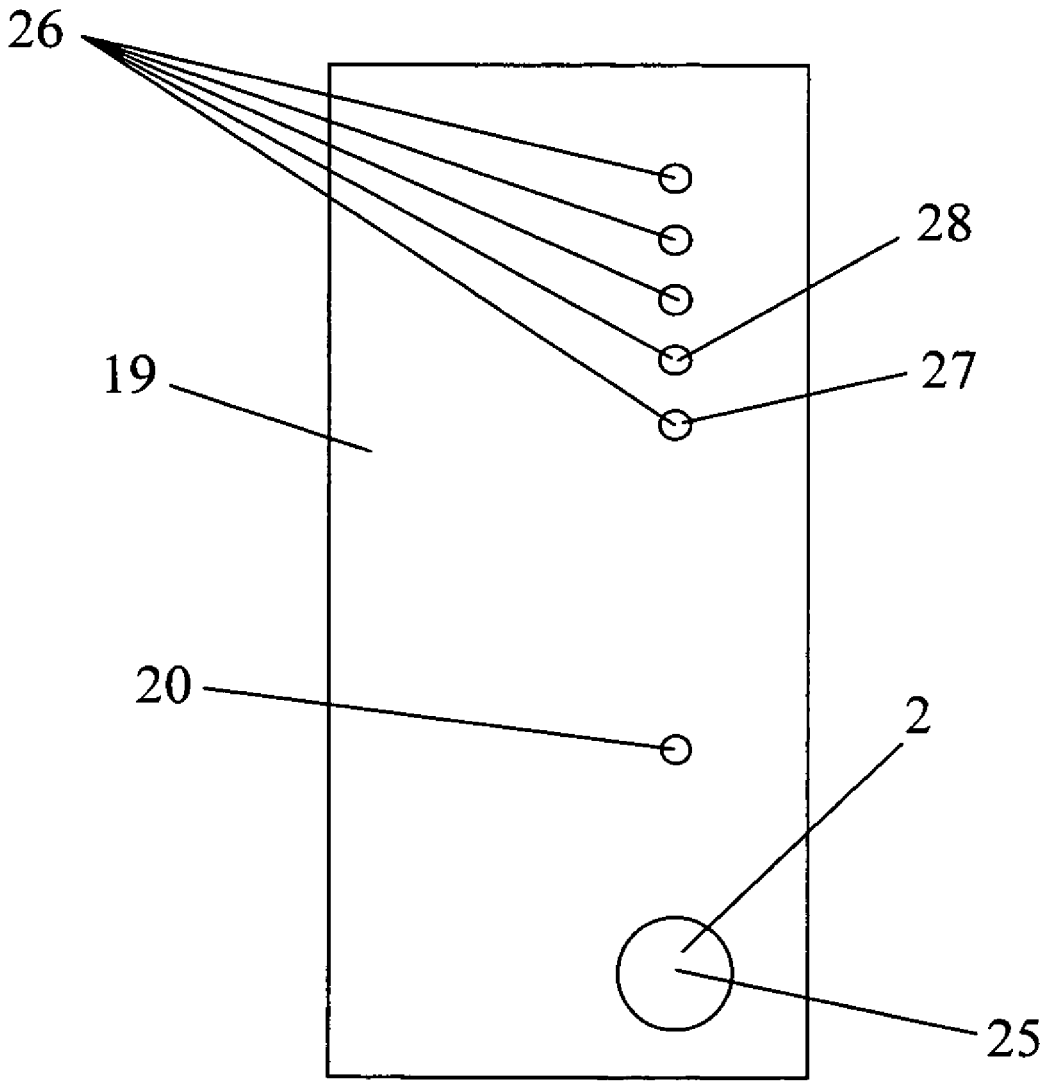
FIG. 5 shows the Discharge Control System from upstream.
Figure 6:
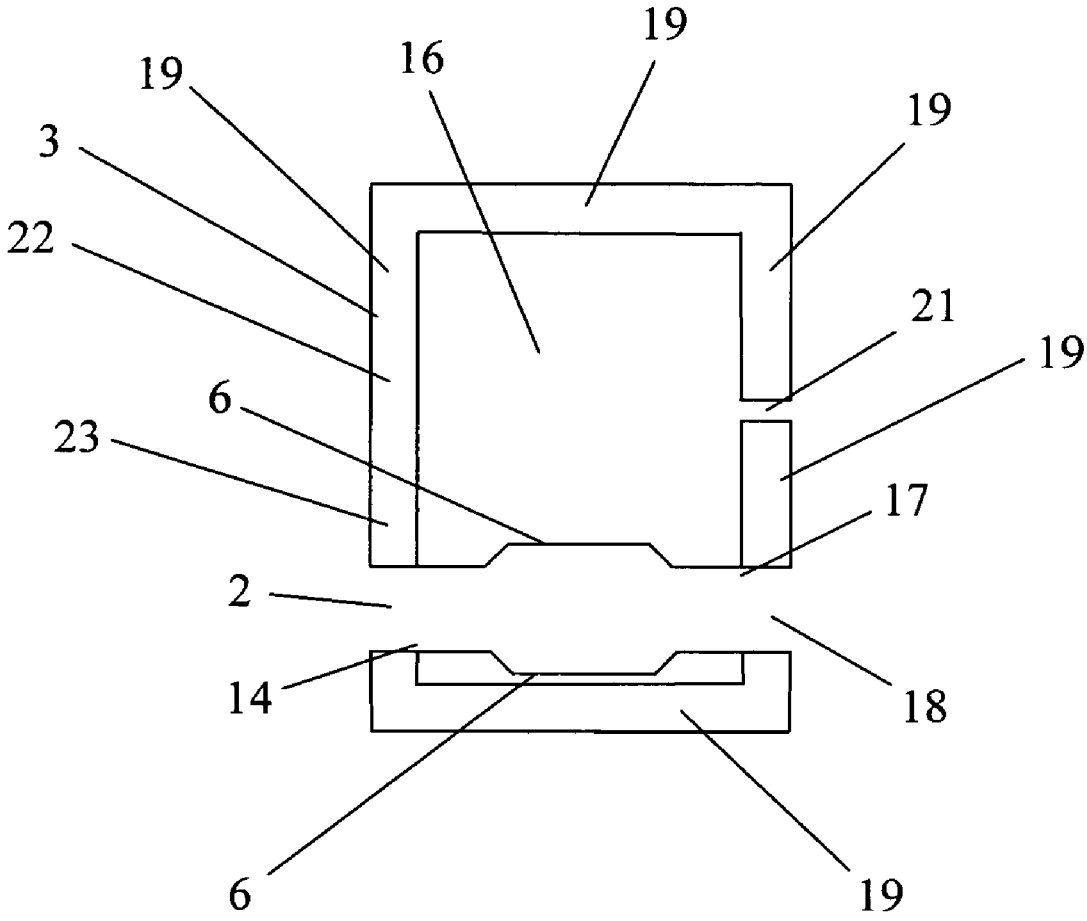
FIG. 6 is a plan cutaway view looking down at the Discharge Control System with the cut of the cutaway view being made along a horizontal plane passing through the center of the reservoir outlet aperture and the center of the valve chamber outlet aperture.

Optionally, rather than having the reservoir outlet aperture 2, the auxiliary reservoir outlet aperture 20, and the one or more supplemental auxiliary reservoir outlet apertures 26 in the containment wall 3 for the reservoir 4 or the portion 22 of the containment structure 19 for the valve chamber 16, it is sometimes desirable to utilize, as portrayed in FIG. 4, a collection box 29 in conjunction with the valve chamber 16.

The collection box 29 is capable of holding water, has an inlet 30 communicating with the reservoir 4, and is vented to the atmosphere so that, unless the level of water in the reservoir 4 is higher than the top 4 of the collection box 29, the level of water in the collection box 29 will be the same as the level of water in the reservoir 4.

In this embodiment, the reservoir outlet aperture 2, the auxiliary reservoir outlet aperture 20, and the one or more supplemental auxiliary reservoir outlet apertures 26 are located in the wall 31 of the collection box 29 above the auxiliary reservoir outlet aperture 20 but are otherwise constructed as described above for the embodiment where they are located in the containment wall 3 of the reservoir 4. And, preferably, the portion 32 of the wall 31 containing the reservoir outlet aperture 2, the auxiliary reservoir outlet aperture 20, and the one or more supplemental auxiliary reservoir outlet apertures 26 is formed as a common wall 33 with a portion 34 of the containment structure 19 for the valve chamber 16, which valve chamber 16 is vented to the atmosphere.

As used herein, the term "substantially" indicates that one skilled in the art would consider the value modified by such terms to be within acceptable limits for the stated value. Also as used herein the term "preferable" or "preferably" means that a specified element or technique is more acceptable than another but not that such specified element or technique is a necessity.

I claim:

1. A discharge control system for a reservoir, which comprises:

a reservoir having a containment wall with a reservoir outlet aperture having a center, in the containment wall and with an auxiliary reservoir outlet aperture in the containment wall above the reservoir outlet aperture;

a valve chamber being capable of holding water, having a containment structure, communicating with the reservoir outlet aperture, possessing a discharge aperture in the containment structure, and having a valve chamber outlet aperture in the containment structure with such valve chamber outlet aperture being substantially the same as the auxiliary reservoir outlet aperture and having a center at essentially the same height as the center of the reservoir outlet aperture; and a pressure-communicating valve located within said valve chamber and having an inlet connected to and in communication with the reservoir outlet aperture and having an outlet connected to and in communication with the discharge aperture.

2. The discharge control system for a reservoir as recited in claim 1, wherein:

said pressure-communicating valve is a dual-duckbill valve.

3. The discharge control system for a reservoir as recited in claim 1, wherein:

one or more supplemental auxiliary reservoir outlet apertures are located at incrementally greater heights in the containment wall for said reservoir above a level in the containment wall of said reservoir at which a level of water in said reservoir will cause a level of water in said valve chamber to exceed the height of the auxiliary reservoir outlet aperture, said one or more supplemental auxiliary reservoir outlet apertures communicating with said valve chamber.

4. The discharge control system for a reservoir as recited in claim 3, wherein:

said pressure-communicating valve is a dual-duckbill valve.

5. A discharge control system for a reservoir, which comprises:

a reservoir having a containment wall with a reservoir outlet aperture having a center, in the containment wall and with an auxiliary reservoir outlet in the containment wall above the reservoir outlet aperture;

a valve chamber being capable of holding water, having a containment structure, communicating with the reservoir outlet aperture, possessing a discharge aperture in the containment structure, and having a valve chamber outlet aperture in the containment structure with such valve chamber outlet aperture being substantially the same as the auxiliary reservoir outlet aperture and having a center at essentially the same height as the center of the reservoir outlet aperture; and a dual-duckbill valve located within said valve chamber and having an inlet connected to and in communication with the reservoir outlet aperture and having an outlet connected to and in communication with the discharge aperture; and wherein one or more supplemental auxiliary reservoir outlet apertures are located at incrementally greater heights in the containment wall for said reservoir above a level in the containment wall of said reservoir at which a level of water in said reservoir will cause a level of water in said valve chamber to exceed the height of the auxiliary reservoir outlet aperture, said one or more supplemental auxiliary reservoir outlet apertures communicating with said valve chamber.

6. A discharge control system for a reservoir, which comprises:

a valve chamber being capable of holding water and having a containment structure with such containment structure having a reservoir outlet aperture having a center, an auxiliary reservoir outlet aperture, a discharge aperture, and a valve chamber outlet aperture with such valve chamber outlet aperture being substantially the same as the auxiliary reservoir outlet aperture and having a center at essentially the same height as the center of the reservoir outlet aperture; and a pressure-communicating valve located within said valve chamber and having an inlet connected to and in communication with the reservoir outlet aperture and having an outlet connected to and in communication with the discharge aperture.

7. The discharge control system for a reservoir as recited in claim 6, wherein:

said pressure-communicating valve is a dual-duckbill valve.

8. The discharge control system for a reservoir as recited in claim 6, wherein:

one or more supplemental auxiliary reservoir outlet apertures are located at incrementally greater heights in the containment structure for said valve chamber above the auxiliary reservoir outlet aperture.

9. The discharge control system for a reservoir as recited in claim 3, wherein:

said pressure-communicating valve is a dual-duckbill valve.

10. A discharge control system for a reservoir, which comprises:

a valve chamber being capable of holding water and having a containment structure with such containment structure having a reservoir outlet aperture having a center, an auxiliary reservoir outlet aperture, a discharge aperture, and a valve chamber outlet aperture with such valve chamber outlet aperture being substantially the same as the auxiliary reservoir outlet aperture and having a center at essentially the same height as the center of the reservoir outlet aperture; and a dual-duckbill valve located within said valve chamber and having an inlet connected to and in communication with the reservoir outlet aperture and having an outlet connected to and in communication with the discharge aperture; and wherein one or more supplemental auxiliary reservoir outlet apertures are located at incrementally greater heights in the containment structure for said valve chamber above the auxiliary reservoir outlet aperture.

11. A discharge control system for a reservoir, which comprises:

a collection box being capable of holding water, being vented to the atmosphere, having an inlet, and having a wall with a reservoir outlet aperture having a center and with an auxiliary reservoir outlet aperture above the reservoir outlet aperture;

a valve chamber being capable of holding water, being vented to the atmosphere, having a containment structure, communicating with the reservoir outlet aperture, possessing a discharge aperture in the containment structure, and having a valve chamber outlet aperture in the containment structure with such valve chamber outlet aperture being substantially the same as the auxiliary reservoir outlet aperture and having a center at essentially the same height as the center of the reservoir outlet aperture; and a pressure-communicating valve located within said valve chamber and having an inlet connected to and in communication with the reservoir outlet aperture and having an outlet connected to and in communication with the discharge aperture.

12. The discharge control system for a reservoir as recited in claim 11, wherein:

said pressure-communicating valve is a dual-duckbill valve.

13. The discharge control system for a reservoir as recited in claim 12, wherein:

one or more supplemental auxiliary reservoir outlet apertures are located at incrementally greater heights in the wall of said collection box above a level in the wall of said collection box at which a level of water in said collection box will cause a level of water in said valve chamber to exceed the height of the auxiliary reservoir outlet aperture, said one or more supplemental auxiliary reservoir outlet apertures communicating with said valve chamber.

14. The discharge control system for a reservoir as recited in claim 13, wherein:

a portion of the wall of said collection box containing the reservoir outlet aperture, the auxiliary reservoir outlet aperture, and the one or more supplemental auxiliary reservoir outlet apertures is formed as a common wall with a portion of the containment structure for said valve chamber.

15. The discharge control system for a reservoir as recited in claim 12, wherein:

a portion of the wall of said collection box containing the reservoir outlet aperture and the auxiliary reservoir outlet aperture is formed as a common wall with a portion of the containment structure for said valve chamber.

16. The discharge control system for a reservoir as recited in claim 11, wherein:

one or more supplemental auxiliary reservoir outlet apertures are located at incrementally greater heights in the wall of said collection box above a level in the wall of said collection box at which a level of water in said collection box will cause a level of water in said valve chamber to exceed the height of the auxiliary reservoir outlet aperture, said one or more supplemental auxiliary reservoir outlet apertures communicating with said valve chamber.

17. The discharge control system for a reservoir as recited in claim 16, wherein:

a portion of the wall of said collection box containing the reservoir outlet aperture, the auxiliary reservoir outlet aperture, and the one or more supplemental auxiliary reservoir outlet apertures is formed as a common wall with a portion of the containment structure for said valve chamber.

18. The discharge control system for a reservoir as recited in claim 11, wherein:

a portion of the wall of said collection box containing the reservoir outlet aperture and the auxiliary reservoir outlet aperture is formed as a common wall with a portion of the containment structure for said valve chamber.

19. A discharge control system for a reservoir, which comprises:

a collection box being capable of holding water, being vented to the atmosphere, having an inlet, and having a wall with a reservoir outlet aperture having a center and with an auxiliary reservoir outlet aperture above the reservoir outlet aperture;

a valve chamber being capable of holding water, being vented to the atmosphere, having a containment structure, communicating with the reservoir outlet aperture, possessing a discharge aperture in the containment structure, and having a valve chamber outlet aperture in the containment structure with such valve chamber outlet aperture being substantially the same as the auxiliary reservoir outlet aperture and having a center at essentially the same height as the center of the reservoir outlet aperture; and a dual-duckbill valve located within said valve chamber and having an inlet connected to and in communication with the reservoir outlet aperture and having an outlet connected to and in communication with the discharge aperture;

wherein one or more supplemental auxiliary reservoir outlet apertures are located at incrementally greater heights in the wall of said collection box above a level in the wall of said collection box at which a level of water in said collection box will cause a level of water in said valve chamber to exceed the height of the auxiliary reservoir outlet aperture, said one or more supplemental auxiliary reservoir outlet apertures communicating with said valve chamber; and wherein a portion of the wall of said collection box containing the reservoir outlet aperture, the auxiliary reservoir outlet aperture, and the one or more supplemental auxiliary reservoir outlet apertures is formed as a common wall with a portion of the containment structure for said valve chamber.

* * * * *